US012471681B2

(12) United States Patent
Miyazaki et al.

(10) Patent No.: US 12,471,681 B2
(45) Date of Patent: Nov. 18, 2025

(54) FASTENER TAPE, METHOD FOR IDENTIFYING SAME, METHOD FOR MANUFACTURING SAME, AND SLIDE FASTENER SET

(71) Applicant: YKK CORPORATION, Tokyo (JP)

(72) Inventors: Yuichi Miyazaki, Toyama (JP); Shigeto Takahashi, Toyama (JP); Hiromi Aoshima, Toyama (JP); Hisanori Ogasawara, Toyama (JP)

(73) Assignee: YKK CORPORATION, Tokyo (JP)

( * ) Notice: Subject to any disclaimer, the term of this patent is extended or adjusted under 35 U.S.C. 154(b) by 0 days.

(21) Appl. No.: 18/889,238

(22) Filed: Sep. 18, 2024

(65) Prior Publication Data

US 2025/0009077 A1 Jan. 9, 2025

Related U.S. Application Data

(62) Division of application No. 17/613,469, filed as application No. PCT/JP2019/025015 on Jun. 24, 2019, now abandoned.

(51) Int. Cl.
*A44B 19/34* (2006.01)
*D03D 1/00* (2006.01)

(52) U.S. Cl.
CPC ..... *A44B 19/346* (2013.01); *D03D 1/00* (2013.01); *D10B 2501/0631* (2013.01)

(58) Field of Classification Search
CPC ..... A44B 19/346; D03D 1/00; D03D 3/005; D10B 2501/0631
See application file for complete search history.

(56) References Cited

U.S. PATENT DOCUMENTS 2,195,895 A * 4/1940 Moore ..... D03D 15/56 139/384 B
2,963,047 A * 12/1960 Monahan ..... A44B 19/346 139/384 B (Continued)

FOREIGN PATENT DOCUMENTS

CN 106127098 A 11/2016
EP 2177126 A1 4/2010

(Continued)

OTHER PUBLICATIONS

"The Guide to Cloth: Weaves and Designs" article from PermanentStyle.com. Retrieved from snapshot on archive.org dated Jan. 27, 2017 https://web.archive.org/web/20170127042912/https://www.permanentstyle.com/2017/01/the-guide-to-cloth-weaves-and-designs.html (Year: 2017).*

(Continued)

*Primary Examiner* — Patrick J. Lynch
*Assistant Examiner* — Brianna T. Duckworth
(74) *Attorney, Agent, or Firm* — Procopio, Cory, Hargreaves & Savitch LLP

(57) ABSTRACT

Fastener tape is woven from a weft thread and warp threads both of which are threads with a main attribute. The fastener tape includes: first and second side-edges extending along an elongation direction of the fastener tape to define a fastener tape width; and a tape main portion interposed between the first and second side-edges. The tape main portion includes an identification region woven by plural warp threads and the weft thread interlaced with one another, the identification region having an identification region width which is a partial width of an entire width of the fastener tape width and is a width in accordance with a number of the plural warp threads. Structure of the identification region is configured to allow identification that the weft thread and the warp (Continued)

threads are with the main attribute and/or to allow identification of a sub-attribute subdivided from the main attribute.

12 Claims, 7 Drawing Sheets

(56) References Cited

U.S. PATENT DOCUMENTS

| | | | | |
|---|---|---|---|---|
| 6,230,373 | B1 | 5/2001 | Wakai et al. | |
| 2014/0223699 | A1 | 8/2014 | Tsuzuyama | |
| 2015/0330018 | A1* | 11/2015 | Zornow | D06H 1/02 428/221 |
| 2018/0174292 | A1 | 6/2018 | Takamori | |

FOREIGN PATENT DOCUMENTS

| | | | |
|---|---|---|---|
| JP | H09251506 | A | 9/1997 |
| JP | H10243805 | A | 9/1998 |
| JP | 2001211913 | A | 8/2001 |
| JP | 2009161884 | A | 7/2009 |
| JP | 2011048710 | A | 3/2011 |
| JP | 2012011235 | A | 1/2012 |
| KR | 970001408 | Y1 | 3/1997 |
| WO | 2015189918 | A1 | 12/2015 |
| WO | 2017057090 | A1 | 4/2017 |
| WO | 2017168731 | A1 | 10/2017 |

OTHER PUBLICATIONS

International Preliminary Report on Patentability mailed on Jan. 6, 2022, from International Application No. PCT/JP2019/025015, 10 pages.

Office Action issued on Apr. 25, 2022 in corresponding Chinese patent application No. 201980094175.4, 18 pages.

Communication pursuant to Article 94(3) EPC issued in corresponding EP Patent Application No. 19934943.2, dated Jun. 19, 2024, 7 pages.

Definition of "interpose" from Vocabulary.com online dictionary. Accessed from https://www.vocabulary.com/dictionary/interpose ( Year: 2024).

Machine Translation (Japanese to English) of JP 2001-211913 A, retrieved from EPO Espacenet. (Year: 2023).

* cited by examiner

FASTENER TAPE, METHOD FOR IDENTIFYING SAME, METHOD FOR MANUFACTURING SAME, AND SLIDE FASTENER SET

CROSS-REFERENCE TO RELATED APPLICATIONS

The present application is a divisional of U.S. patent application Ser. No. 17/613,469, filed on Nov. 22, 2021, which in turn is a U.S. National Stage entry of PCT Application No. PCT/JP2019/025015 filed Jun. 24, 2019, the contents of which are incorporated herein by reference.

TECHNICAL FIELD

The present disclosure is directed to a fastener tape, methods for identifying and producing the same, and a set of slide fasteners.

BACKGROUND ART

As disclosed in patent literatures 1 and 2, it may be desired to supply recyclable slide fasteners in some instances. Para. 0021 of the patent literature 1 describes "Appropriate identifiers can be applied to recyclable products for easier separation and collection of the same from other products not adapted for recycling. For example, visually distinguishable representation such as a character, a code, a barcode or the like can be imprinted onto a slider or a separable stop, or be printed onto a fastener tape . . . or a product to which a slide fastener is attached".

CITATION LIST

Patent Literature

[Patent literature 1] Japanese Patent Application Laid-open No. 10-243805

[Patent literature 2] International Publication No. 2017/168731

SUMMARY

Technical Problem

In recent years, there has been an increasing demand for slide fasteners utilizing fastener tapes that are woven from threads spun from environmentally-friendly material, namely environmentally friendly fastener tapes. In this regard, it may be desired in some cases to present or provide information on the threads (such as whether material having environmentally friendly characteristic is used or not, a type of the material having environmentally friendly characteristic, a supplier of threads, traceability, information on whether it is certified or not, a type of certification, a certifier, or the like) to customers and consumers of slide fastener.

To give a specific example, there are currently plural certifiers certifying that threads of recycled material are used. However, it is not possible to easily identify, by observing the fastener tapes by eyes, a certifier among the plural certifiers that certified the threads used for weaving the fastener tapes. The same applies to the material of threads of fastener tapes (e.g. biodegradable material, plant-derived material or recycled material). Even if the threads were to be analyzed (e.g. spectroscopic analysis), it would be not easy to identify if the threads are certified and to distinguish between virgin material and recycled material. Thus, it is not easy to trace and manage the information of thread of fastener tape in production phase of slide fastener and after delivery of the slide fastener.

As would be understood from the above descriptions, the present inventors have newly recognized a value of supplying a fastener tape which allows identifying if threads of the fastener tape are with a main attribute (e.g. use of the threads with environmentally friendly characteristic or not) or identifying a sub-attribute subdivided from the main attribute (e.g. certificate, supplier or material).

Solution to Problem

Fastener tape according to an aspect of the present disclosure is a fastener tape woven from a weft thread and warp threads both of which are threads with a main attribute. The fastener tape includes first and second side-edges extending along an elongation direction of the fastener tape to define a fastener tape width; and a tape main portion interposed between the first and second side-edges. The tape main portion includes an identification region woven by plural warp threads and the weft thread interlaced with one another. The identification region has an identification region width which is a partial width of an entire width of the fastener tape width and is a width in accordance with a number of the plural warp threads. Structure of the identification region is configured to allow identification that the weft thread and the warp threads are with the main attribute and/or to allow identification of a sub-attribute subdivided from the main attribute.

In some embodiments, a weave repeat or a weave pattern of the identification region is configured to allow identification of a sub-attribute subdivided from the main attribute. In some embodiments, a weave repeat of the identification region is configured to allow identification of a sub-attribute subdivided from the main attribute.

In some embodiments, the main attribute is related to environmentally friendly characteristic. The environmentally friendly characteristic may be related to any one of use of recycled material, use of biodegradable material, use of plant-derived material or a combination thereof.

In some embodiments, the structure of the identification region configured to allow identification of the sub-attribute subdivided from the main attribute is a warp-rib-free structure. In some embodiments, the structure of the identification region configured to allow identification that the weft thread and the warp threads are with the main attribute is a warp-rib structure. In some embodiments, the identification region includes a first identification region woven to allow identification that the weft thread and the warp threads are with the main attribute and a second identification region woven to allow identification of a sub-attribute subdivided from the main attribute. The first identification region and the second identification region may be adjacent in a weft direction.

In some embodiments, a fastener element is provided such that an engagement head is positioned outwardly of fastener tape than the first side-edge of the fastener tape, and the identification region is arranged closer to the second side-edge relative to the first side-edge of the fastener tape. In some embodiments, an element-attachment region and an intermediate region interposed between the element-attachment region and the identification region are arranged in a direction directed from the first side-edge of the fastener tape toward the identification region in the tape main portion. The identification region width is less than a width of the intermediate region in a same direction. In some embodiments, the intermediate region and the identification region are arranged in the tape main portion adjacently in a direction directed from the first side-edge toward the second side-edge of the fastener tape. In both of the intermediate region and the identification region, the respective warp threads repeat passing over pairs of two weft thread portions adjacent in a warp direction.

Method of identifying a fastener tape according to an aspect of the present disclosure is a method of identifying a fastener tape woven from a weft thread and warp threads. This method includes: identifying one or more identification regions in the fastener tape, the identification region being woven by the plural warp threads and the weft thread interlaced with one another; identifying, based on the identified identification region, that the weft thread and the warp threads are with a main attribute; and in addition to or as an alternative of said identifying that the weft thread and the warp threads are with a main attribute, identifying a sub-attribute preassociated with a structure of the identified identification region among sub-attributes subdivided from the main attribute. Slide fasteners can be distinguishable based on identifying the fastener tapes. That is, the method of identifying is implemented for a first fastener tape of a first slide fastener and the method of identifying is implemented for a second fastener tape of a second slide fastener, thereby the first and second slide fasteners can be distinguishable based on the above implementations of the identifying method. Various features related to fastener tape is applicable to the present identifying method.

In some embodiments, the sub-attribute can be identified based on reference to a correspondence table between a sub-attribute and a weave repeat or weave pattern of the identification region.

Set of slide fasteners according to an aspect of the present disclosure is a set of mutually distinguishable slide fasteners. This set includes a first slide fastener including a pair of first fastener tapes each of which is woven from warp threads and a weft thread which are threads with a main attribute; and a second slide fastener including a pair of second fastener tapes each of which is woven from warp threads and a weft thread which are threads with the main attribute. Each of the first and second fastener tapes includes: first and second side-edges extending along an elongation direction of the fastener tape to define a fastener tape width; and a tape main portion interposed between the first and second side-edges. The tape main portion includes an identification region woven by adjacent warp threads and the weft thread interlaced with one another. The identification region has an identification region width which is a partial width of an entire width of the fastener tape width and is a width in accordance with a number of the adjacent warp threads. Structure of the identification region of the first fastener tape is configured to indicate that the weft thread and the warp threads are with the main attribute and/or is associated with a first sub-attribute included in sub-attributes subdivided from the main attribute. Structure of the identification region of the second fastener tape is configured to indicate that the weft thread and the warp threads are with the main attribute and/or is associated with a second sub-attribute included in sub-attributes subdivided from the main attribute.

In some embodiments, a weave repeat or a weave pattern of the identification region of the first fastener tape is associated with the first sub-attribute included in the sub-attributes subdivided from the main attribute. A weave repeat or a weave pattern of the identification region of the second fastener tape is associated with the second sub-attribute included in the sub-attributes subdivided from the main attribute.

Method of producing a fastener tape according to an aspect of the present disclosure is related to a method of producing a fastener tape configured from threads with a main attribute. This method includes: supplying first threads with the main attribute to an automatic loom in a first setting to weave a first fastener tape, a first identification region being formed in the first fastener tape in accordance with the first setting; and supplying second threads with the main attribute to an automatic loom in a second setting to weave a second fastener tape, a second identification region being formed in the second fastener tape in accordance with the second setting. Structure of the first identification region is configured to indicate that the first threads are with the main attribute and/or is associated with a first sub-attribute included in sub-attributes subdivided from the main attribute. Structure of the second identification region is configured to indicate that the second threads are with the main attribute and/or is associated with a second sub-attribute included in sub-attributes subdivided from the main attribute.

In some embodiments, the first sub-attribute can be identified from the structure of the first identification region based on a correspondence table defining correspondence between a sub-attribute subdivided from the main attribute and a structure of the identification region of the fastener tape, and the second sub-attribute can be identified from the structure of the second identification region based on the correspondence table. In some embodiments, first and second settings of the automatic loom correspond to first and second cam patterns in the automatic loom.

Advantageous Effects of Invention

According to an aspect of the present disclosure, it may be facilitated to supply a fastener tape which allows identifying if threads of the fastener tape are with a main attribute (e.g. use of the threads with environmentally friendly characteristic or not) or identifying a sub-attribute subdivided from the main attribute (e.g. certificate, supplier or material).

BRIEF DESCRIPTION OF DRAWINGS

FIG. 8 (*b*) is an illustration illustrating that the weave repeat is a derived structure from a weave repeat shown in FIG. 5.

DESCRIPTION OF EMBODIMENTS

Figure 1:
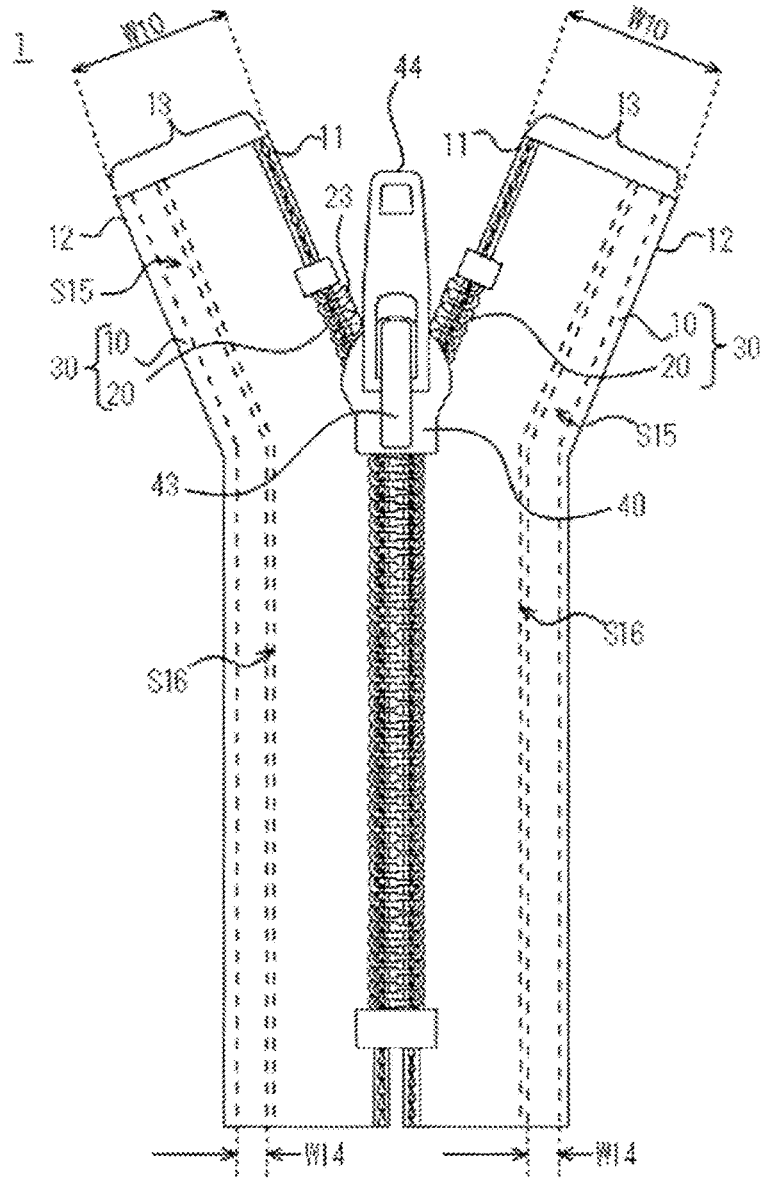
FIG. 1 is a schematic top view of a slide fastener according to an aspect of the present disclosure.
Figure 2:
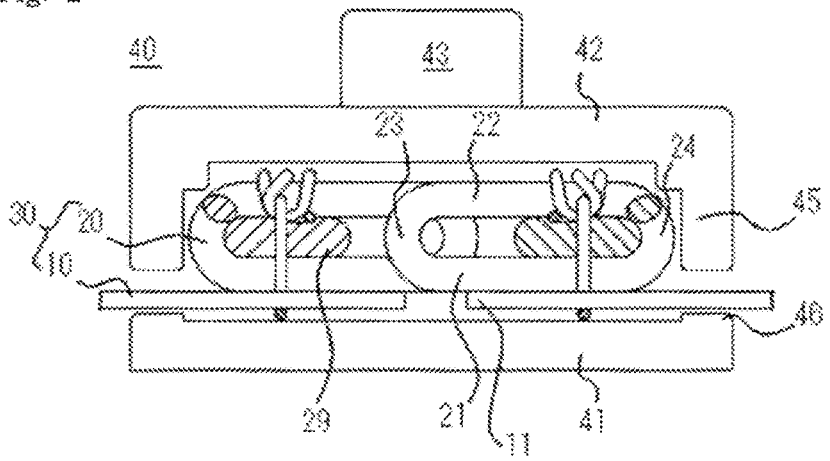
FIG. 2 is a schematic illustration showing left and right fastener elements coupled in a slider.

Hereinafter, various embodiments and features will be discussed with reference to FIGS. 1 to 14. Skilled person in the art would be able to combine the respective embodiments and/or respective features and appreciate the technical effects by such combination without excess descriptions. Overlapping descriptions among embodiments would be omitted basically. Reference drawings are mainly for describing the invention and may be simplified for ease of preparation thereof. Each feature should be understood as a universal feature which is effective not only for the presently disclosed fastener tapes, the method of identifying them, and the method of producing them but also for various fastener tapes, methods of identifying them, and methods of producing them which are not disclosed in the present specification.

Hereinafter, a front-rear direction would be understood based on a movement direction of a slider, and thus a slide fastener would be closed by the slider moving frontward and would be opened by the slider moving rearward. Left-right direction and up-down direction are orthogonal to the front-rear direction. The left-right direction is a direction parallel to a tape surface of the fastener tape. The up-down direction is perpendicular to the tape surface of the fastener tape. These terms indicating directions could be redefined in view of the following descriptions.

Slide fastener 1 has a pair of left and right fastener stringers 30 and a slider 40 for opening and closing the pair of left and right fastener stringers 30. The slide fastener 1 may be used in various applications such as clothing, shoes, bags, bedding, outdoor equipment, and wetsuits. Although not illustrated, an embodiment is envisioned where the slide fastener 1 is a conceal-type slide fastener to which the following features would be equally applicable.

Each fastener stringer 30 has a fastener tape 10 and a fastener element 20. The fastener tape 10 is a soft fabric and is woven from a weft thread 8 and warp threads 9 (See FIG. 6) which have a main attribute. The fastener tape 10 includes first and second side-edges 11,12 extending along an elongation direction of the fastener tape (the front-rear direction) to define a fastener tape width W10 that is a dimension in the left-right direction, and a tape main portion 13 interposed between the first and second side-edges 11,12.

The fastener element 20 is a coil-like element configured from a monofilament helically extending along the elongation direction of the fastener tape 10, and is sewn by yarns onto the fastener tape 10 at its top surface. Embodiment is envisioned where the fastener element 20 is inwoven to a weave region of the fastener tape 10. Furthermore, embodiment is envisaged where the fastener element 20 is provided as metal-made or resin-made elements arranged by constant interspace along the elongation direction of the fastener tape 10.

The fastener element 20 is configured from a series of units each having a lower leg 21, an upper leg 22, an engagement head 23 and a return portion 24. The lower leg 21 is placed on the fastener tape 10 at its top surface, and the upper leg 22 is positioned away from the top surface of the fastener tape 10. The engagement head 23 is positioned outside of the fastener tape 10, i.e. outwardly of fastener tape than the first side-edge 11 of the fastener tape 10. Note that outwardly of fastener tape is a direction directed from a position or point on a top or bottom surface of the fastener tape to a position or point outside of the top or bottom surface of the fastener tape. Inwardly of fastener tape is a direction directed to the opposite side of outwardly of fastener tape.

The engagement head 23 extends in the up-down direction to couple the ends of the lower leg 21 and the upper leg 22 (i.e. the ends positioned outwardly of fastener tape). The engagement head 23 is an enlarged portion of the monofilament in its width (i.e. the width in the front-rear direction) relative to the lower and upper legs 21 and 22. The return portion 24 couples the ends of the lower leg 21 and the upper leg 22 (i.e. the ends positioned inwardly of fastener tape) so as to configure the helix of monofilament. Unlike the engagement head 23, the return portion 24 is not enlarged in its width in the front-rear direction. Optionally, a core thread 29, extending along the elongation direction of the fastener tape 10, is arranged inside of the helix of the monofilament.

The slider 40 has a bottom wing 41, a top wing 42, a interconnecting pillar (not shown), a pull tab attachment post 43 and a pull tab 44. The slider 40 has a Y-shaped element-passage bifurcated by the interconnecting pillar. Left and right front mouths are arranged to sandwich the interconnecting pillar, and a rear mouth is arranged at the opposite side of the front mouths in the front-rear direction. When the slider 40 moves rearward, a coupled left and right fastener elements 20 enter into the slider 40 through its rear mouth. Next, the coupled left and right fastener elements 20 is decoupled by the interconnecting pillar, and the left and right fastener elements 20 move out of the slider 40 through the left and right front mouths. The slider 40 may be made of resin or metal.

Figure 3:
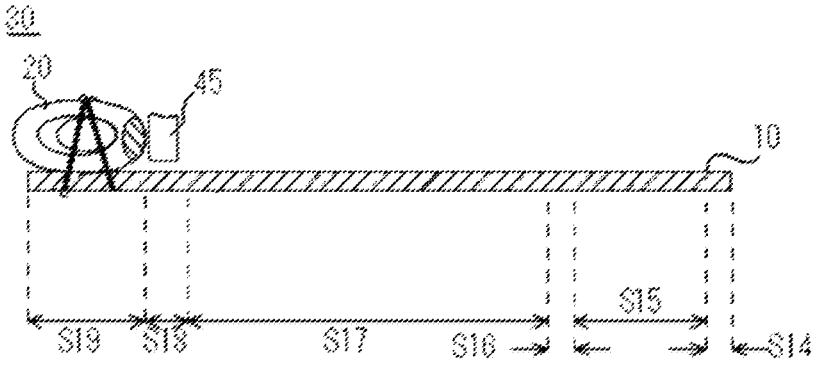
FIG. 3 is a schematic illustration of a fastener tape partitioned into plural weave regions.

As shown in FIG. 3, the fastener tape 10 is partitioned into plural regions in the left-right direction. For example, the fastener tape 10 is partitioned into a plain weave region S14, an identification region S15, an identification region S16, an intermediate region S17, and a plain weave structure S18, and an element-placement region S19. The plain weave region S14, the identification region S15, the identification region S16, the intermediate region S17, the plain weave structure S18 and the element-placement region S19 are configured from a weft thread 8 and warp threads 9 which are threads with a main attribute. Embodiment is envisioned where the plain weave region S14 is omitted and a side edge of the identification region S15 matches second side-edge 12 of the fastener tape 10. For distinguishing the identification region S15, S16, the identification region S16 may be referred to as a main identification region, and the identification region S15 may be referred to as a sub-identification region.

The main attribute of threads is an attribute that is not easily or practically not possible for human sight to recognize, and an example of which can be environmentally friendly characteristic, not necessarily limited to this though. The environmentally friendly characteristic may be related to one or any combination of characteristics such as (i) threads spun from recycled material, (ii) threads spun from biodegradable material, and (iii) threads spun from plant-derived material. The environmentally friendly characteristic can be subdivided into certificates of thread, suppliers of thread, and materials of thread. GRS (Global Recycle Standard) can be suggested as an example of the certificate of threads. Exemplary material of thread includes a synthetic fiber such as made of nylon, polyamide, polyester and polyurethane, and a natural fiber such as cotton, wool and silk.

In the present embodiment, the structure of the identification region S16 is configured to allow identification that the weft thread 8 and the warp threads 9 are with the main attribute. The structure of the identification region S16 is used as an indication that the weft thread 8 and the warp threads 9 are with the main attribute. The structure of the identification region S16 and the aspect of the weft thread 8 and the warp threads 9 with the main attribute are preassociated. It could be said that the structure of the identification region S16 indicates the aspect of the weft thread 8 and the warp threads 9 with the main attribute, based on the predesigned correspondence between a structure of the identification region S16 and an aspect of the weft thread 8 and the warp threads 9 with the main attribute.

The structure of the identification region S16 is an indication of the main attribute of the weft thread 8 and the warp threads 9, and in some cases, recognizable as a characteristic portion on the fastener tape 10 through human visual or tactile sensation. For example, in a case where the structure of the identification region S16 is a warp rib structure, a person can recognize easily through visual or tactile sensation the rib extending in the warp direction between the first and second side-edges 11 and 12 of the fastener tape 10. This enables identification of the main attribute (e.g. the environmentally friendly characteristic) of the threads used as the warp threads and/or the weft thread of the fastener tape 10 based on the presence of the identification region S16 of the fastener tape 10 after the fastener tape 10 is woven or after the slide fastener 1 is sold. If the fastener tape 10 is not provided with the identification region S16, that fastener tape 10 can be identified as lacking the main attribute (e.g., the environmentally friendly characteristic). Embodiment is envisioned where plural identification regions S16 are provided. For example, two or more ribs extending in parallel in the warp direction may be used as the identification region S16.

Additionally or alternatively to the above-described feature that the structure of the identification region S16 is configured to allow identification that the weft thread 8 and the warp threads 9 are with the main attribute, the structure of the identification region S15 may be configured to allow identification of a sub-attribute subdivided from the main attribute. In other words, the identification region S15 is used as an indication of the sub-attribute. The structure of the identification region S15 is a structure preassociated with the sub-attribute subdivided from the main attribute. Based on the predesigned correspondence between a sub-attribute and an identification region S15, a sub-attribute can be identified from a structure of the identification region S15 preassociated therewith.

A "weave repeat" of the identification region S15 may be preassociated with a sub-attribute subdivided from the main attribute, not necessarily limited to this though. For example, a weave repeat of the identification region S15 of the first fastener tape is preassociated with a first sub-attribute included in sub-attributes subdivided from the main attribute, and a weave repeat of the identification region S15 of the second fastener tape is preassociated with a second sub-attribute included in the sub-attributes subdivided from the main attribute. This enables identification of sub-attribute of the threads used as the warp threads and/or the weft thread of the fastener tape 10 by identifying the weave repeat of the identification region S15 of the fastener tape 10 after the fastener tape 10 is woven or after sold as the slide fastener 1.

Advantageously, the correspondence table between a sub-attribute and a structure of identification region S15 (e.g. weave repeat) may be referenced. In typical situations, weave repeats of identification region S15 are respectively associated with sub-attributes subdivided from the main attribute. Note that, the weave repeats of identification region S15 may be observed through an enlarging optical system e.g. by a human or an image recognition device using a microscope or an imager. As known in the present technical field, a weave repeat indicates a minimum repeating unit of weave pattern of tape structure. The tape structure is configured by a series of weave repeats in the warp direction and/or in the weft direction. Note that, the identification region S15 should not be necessarily limited to the series of weave repeat, but may be associated with a particular attribute based on its weave pattern different from other regions.

The fastener tape is woven by an automatic loom to which threads with known main attribute and sub-attribute are supplied. Setting of the automatic loom is determined based on the main attribute and the sub-attribute of the threads supplied to the automatic loom. For example, a first identification region is formed in a first fastener tape in accordance with a first setting of the automatic loom, and a second identification region is formed in a second fastener tape in accordance with a second setting of the automatic loom. Here, the structure of the first identification region is configured to indicate that the weft thread 8 and the warp threads 9 are with the main attribute and/or is associated with a first sub-attribute included in sub-attributes subdivided from the main attribute. The structure of the second identification region is configured to indicate that the weft thread 8 and the warp threads 9 are with the main attribute and/or is associated with a second sub-attribute included in sub-attributes subdivided from the main attribute. Based on the identification region, the fastener tape can be identified as having the main attribute and/or a sub-attribute can be identified which is associated with that identification region. A weave repeat of the identification region of the first fastener tape is associated with a first sub-attribute included in sub-attributes subdivided from the main attribute, not necessarily limited to this though. A weave repeat of the identification region of the second fastener tape is associated with a second sub-attribute included in sub-attributes subdivided from the main attribute. Based on identification of a weave repeat of the identification region of the fastener tape 10, a sub-attribute can be identified which is preassociated with that weave repeat.

Further stating without intension of restriction, in cases where the main attribute is related to environmentally friendly characteristic, the environmentally friendly characteristic can be subdivided by certificates respectively issued by certifiers. Identification of weave repeat of identification region S15 allows identification of certificate preassociated with that identified weave repeat. It would be possible to similarly understand a case where the environmentally friendly characteristic is subdivided into respective materials. The weave repeat of the identification region S15 of the fastener tape 10 is assumed to be not susceptible to peeling-off and deterioration which otherwise results in disabled identification, unlike impressing or printing of identification signs. In a case where an identification sign is applied through impressing or printing, a possibility of disabled identification may not be excluded due to peeling-off or deterioration of the identification sign. Moreover, the identification sign may be noticeable, resulting in deteriorated appearance of product which is unfavorable.

Figure 4:
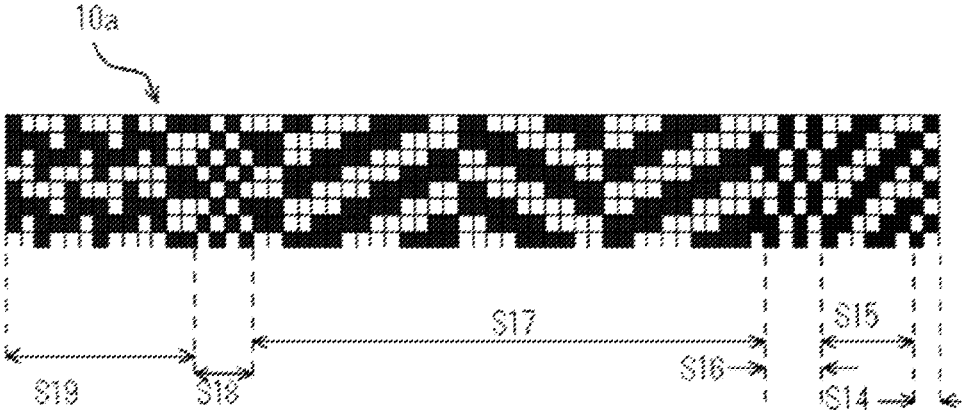
FIG. 4 is a structure view of a tape main portion of a fastener tape provided with an identification region representing that warp and weft threads are with a main attribute, and an identification region having a weave repeat associated with a certificate of a first working example.
Figure 5:
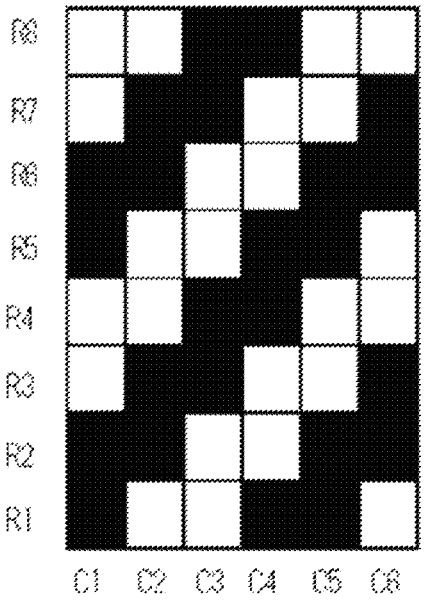
FIG. 5 is a structure view showing a weave repeat associated with a certificate of a first working example.
Figure 6:
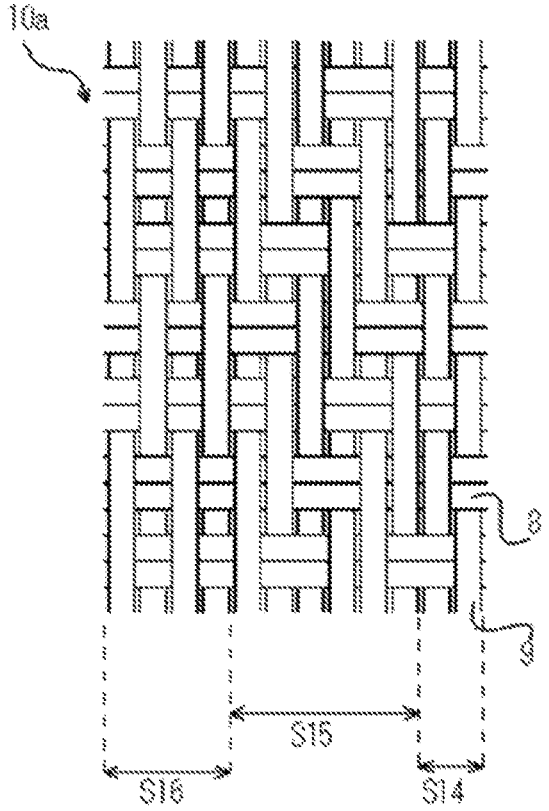
FIG. 6 is a partial view of a fastener tape showing an identification region and weave regions at both left and right sides thereof.
Figure 7:
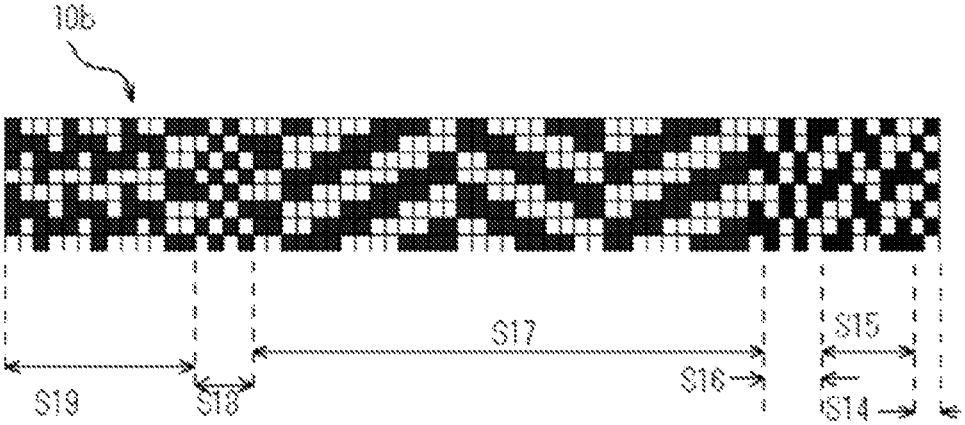
FIG. 7 is a structure view of a tape main portion of a fastener tape provided with an identification region representing that warp and weft threads are with a main attribute, and an identification region having a weave repeat associated with a certificate of a second working example.
Figure 8:
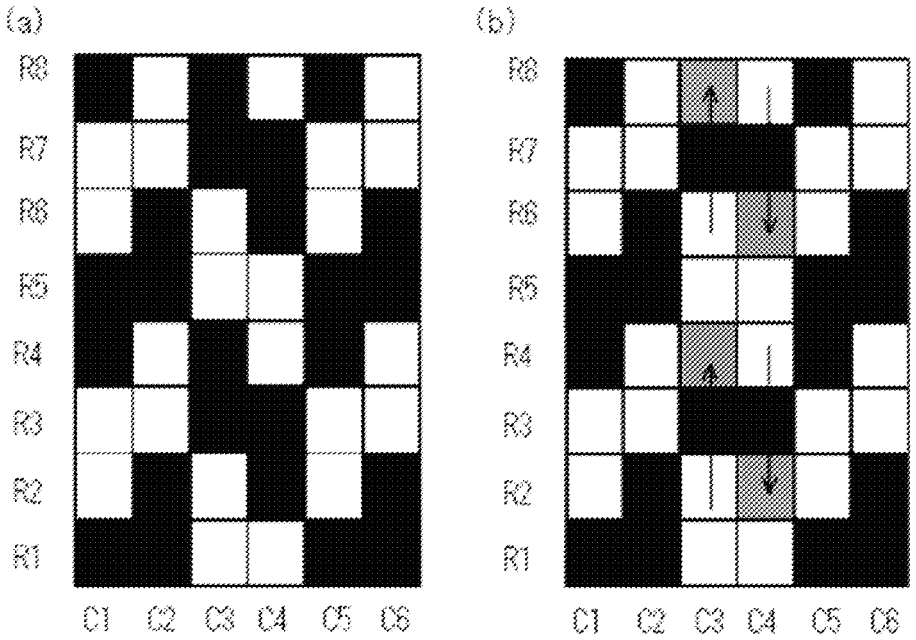
FIG. 8 (*a*) is a structure view of a weave repeat associated with a second working example.
Figure 9:
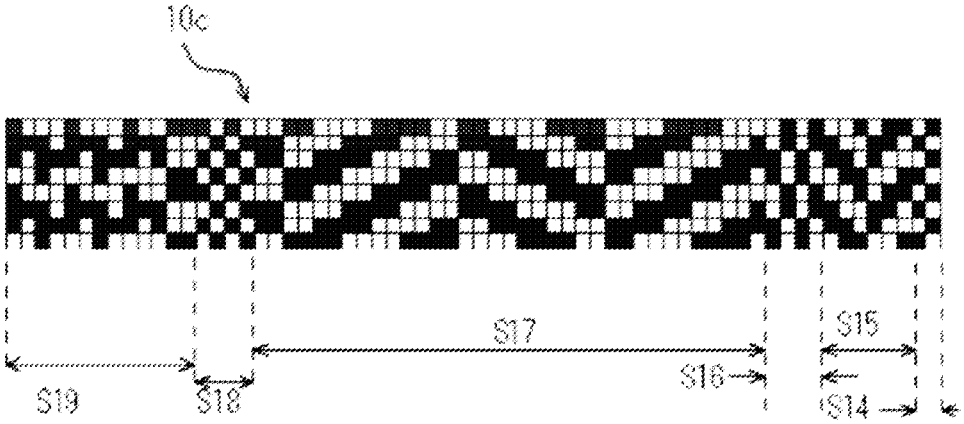
FIG. 9 is a structure view of a tape main portion of a fastener tape provided with an identification region representing that warp and weft threads are with a main attribute, and an identification region having a weave repeat associated with a certificate of a third working example.
Figure 10:
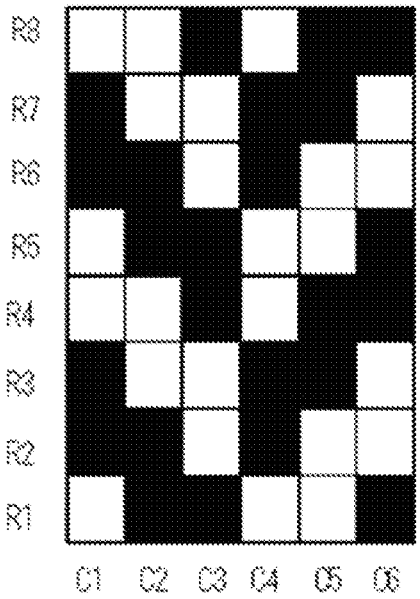
FIG. 10 is a structure view of a weave repeat associated with certificate of a third working example.

The above-described features will be discussed more concretely with reference to FIGS. 4-10. FIG. 4 is a structure view of a tape main portion of a fastener tape provided with an identification region representing that warp and weft threads are with a main attribute, and an identification region having a weave repeat associated with a certificate of a first working example. FIG. 5 is a structure view showing a weave repeat associated with a certificate of a first working example. FIG. 6 is a partial view of a fastener tape showing an identification region and regions at both left and right sides thereof. FIG. 7 is a structure view of a tape main portion of a fastener tape provided with an identification region representing that warp and weft threads are with a main attribute, and an identification region having a weave repeat associated with a certificate of a second working example. FIG. 8 (*a*) is a structure view of a weave repeat associated with a second working example. FIG. 8 (*b*) is an illustration illustrating that the weave repeat is a derived structure from a weave repeat shown in FIG. 5. FIG. 9 is a structure view of a tape main portion of a fastener tape provided with an identification region representing that warp and weft threads are with a main attribute, and an identification region having a weave repeat associated with a certificate of a third working example. FIG. 10 is a structure view of a weave repeat associated with certificate of a third working example.

When an automatic loom is supplied with threads certified by a first certificate, a structure of the fastener tape 10 such as one shown in FIG. 4 is configured in accordance with a first setting (first cam pattern) of the automatic loom (weave repeat in the entire width of the fastener tape 10 is shown in FIG. 4). The identification region S16 is a warp rib structure having a rib width corresponding to total 4 warp threads, representing that the warp and weft threads are with the main attribute. The weave repeat of the identification region S15 is a derived structure from a twill weave as shown in FIG. 5, representing that the fastener tape 10 is woven by threads certified by a first certificate. In the derived structure from the twill weave shown in FIG. 5, the respective warp threads repeat passing over a pair of two weft thread portions adjacent in the warp direction.

As a supplemental description for FIGS. 4 and 5, as well-known in the present technical field, a filled cell in the structure view indicates a state of warp thread striding over weft thread, so-called "floating" state of warp thread over weft thread. Blank cell in the structure view indicates a state of warp thread striding under weft thread, so-called "sinking" state of warp thread under weft thread. This would be more concretely understood by comparing FIGS. 4 and 6. As would be understood from FIG. 6, the respective warp threads pass over or under a pair of weft threads portions adjacent in the warp direction (front-rear direction). The pair of weft thread portions adjacent in the warp direction (front-rear direction) is a unit of weft thread to be stridden by the warp threads, but not necessarily limited thereto. The weft thread is structured in accordance with reciprocating motion of a shuttle in the weft direction (the left-right direction). Therefore, embodiment is envisioned where the respective warp threads pass over or under one weft thread portion extending in the weft direction.

The identification region S15 is a series of weave repeats of the identification region S15 arranged in the warp direction, and is not a series of weave repeats arranged in the weft direction, allowing easier identification of weave repeat of the identification region S15. Increased number of warp threads and weft threads included in the weave repeat of the identification region S15 results in increased number of variations of the weave repeat. However, if the weave repeat of the identification region S15 is too wide, it may be not easier to recognize it in some cases. The number of warp threads 9 included in the weave repeat of the identification region S15 may be in a range between 3 and 10 in some cases. Preferably, the number of warp threads 9 included in the identification region S15 is equal to or less than 9 or equal to or less than 8 or equal to or less than 7 or equal to or less than 6. With such number of warp threads, the weave repeat of the identification region S15 may have necessary and sufficient number of variations. In other words, the weave repeat of the identification region S15 can represent necessary and sufficient number of 2-dimensional codes.

For facilitated identification of the identification region S15 or the weave repeat thereof, the identification region S15 may be structured differently, when seen by the eyes, relative to one or both regions adjacent thereto. As shown in FIG. 4, a plain weave region S14 and the identification region S16, configured as a warp rib region, are provided at both left and right sides of the identification region S15, and thus it would be possible to easily observe the identification region S15 by the eyes or using a microscope. The warp rib structure of the identification region S16 is a derived structure from a plain weave. The warp threads in the plain weave region stride one pair of weft thread portions, but the warp threads in the warp rib region stride two pairs of weft thread portions. The warp rib region looks like a rib extending in the warp direction (front-rear direction) for bare eyes. In some cases, the warp rib region is provided purposely for determining if the warp and weft threads of the fastener tape 10 are with the main attribute (e.g., environmentally friendly characteristic) or not.

As illustrated in FIG. 4, the identification region S15 is arranged closer to the second side-edge 12 relative to the first side-edge 11 of the fastener tape 10. Preferably, the plain weave region S14 is interposed between the second side-edge 12 and the identification region S15, and one side edge of the plain weave region S14 matches the second side-edge 12 of the fastener tape 10. As such, the identification region S15 is positioned far from the element-placement region S19, minimizing influence given by the identification region S15 to operation of opening and closing the slide fastener.

As shown in FIG. 4, the identification regions S15 and S16 are arranged adjacent in the weft direction (left-right direction), but should not be limited to this. Unlike the illustration of FIG. 4, embodiments are envisaged where the identification regions S15 and S16 are arranged oppositely in the left-right direction. That is, the identification region S16 may be positioned closer to the second side-edge 12 of the fastener tape 10 than the identification region S15, and the identification region S15 may be positioned closer to the first side-edge 11 of the fastener tape 10 than the identification region S16. Embodiment is envisioned where an intermediate region, having a different structure relative to the structures of the identification regions S15 and S16, is interposed between the identification regions S15 and S16.

The structures of respective ones of the intermediate region S17, the plain weave structure S18, and the element-placement region S19 would be properly configured by a skilled person in the art. In the case shown in FIG. 4, the intermediate region S17 is configured by 3 sets of twilled regions. The plain weave structure S18 is a narrow-width region of 3 warp threads, and is provided to resist contact with a flange of the slider. The element-placement region S19 is a derived structure from a plain weave structure. As would be clear for a skilled artisan, return portions of the weft thread are continuously formed along the first and second side-edges 11 and 12. The width of the identification region S15 in the weft direction (left-right direction) is narrower than the width of the intermediate region S17. As such, easier identification would be possible without affecting the appearance of the entirety of the fastener tape 10. Preferably, in the first working example, the tape main portion 13 has a warp rib region S16, and the intermediate region S17, the warp rib region S16 and the identification region S15 are continuously arranged in a direction directed from the first side-edge 11 to the second side-edge 12 of the fastener tape 10. The respective warp threads included in the respective regions in the identification region S15, the warp rib region S16 and the intermediate region S17 repeat passing over a pair of two weft thread portions adjacent in a warp direction. As such, it is suppressed that the number of cam patterns of a loom is redundantly increased and the burden of managing them and the cost of production increase.

In the second working example, when the automatic loom is supplied with threads certified by a second certificate, a structure of the fastener tape 10 such as one shown in FIG. 7 is configured in accordance with a second setting (second cam pattern) of the automatic loom (weave repeat in the entire width of the fastener tape 10 is shown in FIG. 7). The identification region S16 is a warp rib structure having a rib width corresponding to total 4 warp threads, representing that the warp and weft threads are with the main attribute. The fastener tape 10 of FIG. 7 differs from that of FIG. 4 in the structure of the identification region S15. The weave repeat of the identification region S15 of the fastener tape 10 of FIG. 7 is a derived structure from the weave repeat shown in FIG. 5 (similarly a derived structure from a twill weave), representing that the fastener tape 10 is woven by threads certified by second certificate.

As would be understood from FIG. 8 (*b*), in a weave repeat having rows R1-R8 and columns C1-C6, a cell at coordinates (R4,C3) is filled in lieu of a cell at coordinates (R2,C3); a cell at coordinates (R8,C3) is filled in lieu of a cell at coordinates (R6,C3); a cell at coordinates (R2,C4) is filled in lieu of a cell at coordinates (R4,C4); and a cell at coordinates (R6,C4) is filled in lieu of a cell at coordinates (R8,C4). The weave repeat of FIG. 8 (*a*) is a derived structure, i.e. a variant, where 4 filled cells are shifted in position relative to the weave repeat of FIG. 5. In some cases, filled cells may be added or deleted additionally or alternatively to the shifting of the filled cells in its position. As an addition or alternative to such manipulation of filled cells, manipulation can be done to the blank cells. In some cases, there is no change in the number of filled cells before and after the cells are manipulated, facilitating to ensure a given strength and softness of the structure, not necessarily limited to this though.

In the third working example, when the automatic loom is supplied with threads certified by a third certificate, a structure of the fastener tape 10 such as one shown in FIG. 9 is configured in accordance with a third setting (third cam pattern) of the automatic loom (weave repeat in the entire width of the fastener tape 10 is shown in FIG. 9). The identification region S16 is a warp rib structure having a rib width corresponding to total 4 warp threads, representing that the warp and weft threads are with the main attribute. The fastener tape 10 of FIG. 9 differs from those of FIGS. 4 and 7 in the structure of the identification region S15. The weave repeat of the identification region S15 of the fastener tape 10 of FIG. 9 is a derived structure from the weave repeat shown in FIG. 5 (similarly a derived structure from a twill weave), representing that the fastener tape 10 is woven by threads certified by a third certificate. As would be understood from FIG. 10, the weave repeat of the identification region S15 is equal to a weave repeat formed by interchanging the left and right parts of the weave repeat of FIG. 5 with respect to a border between the columns C3 and C4.

Again, in the present embodiment, the weave repeat of the identification region S15 allows identification of the sub-attribute subdivided from the main attribute. For example, the weave repeat of the identification region S15 in the fastener tape 10 may be observed through an enlarging optical system and its weave repeat may be identified. By checking which one of patterns of FIG. 5, FIG. 8 (*a*) and FIG. 10 the identified identification region has, it would be possible to identify by which one of the first to third certificates the threads are certified which are used as the warp and weft threads of the given fastener tape 10. The same should be applicable for identification of material and supplier of the threads. As described above, the weave repeats of identification region and the sub-attributes are preassociated beforehand, and the correspondence table, i.e. look-up table has been predesigned.

At the time of production of the slide fasteners and even after delivery of the slide fasteners, the main attribute and/or the sub-attribute of the threads used therein can be identified based on the identification regions S15 and S16. The fastener tape 10 may be processed through various steps after woven by the automatic loom. For example, a fastener element is sewn to it, or it is supplied to a dyeing step or to an assembling machine of slide fastener. Various types of fastener tape 10 may be processed in the same machine (e.g. the assembling machine of slide fastener). Therefore, from an aspect of production management, it would be advantageous to allow one to identify by which one of certificates the produced slide fasteners have been certified at the time of their shipping. Particularly, in cases where not just two classification of with and without environmentally friendly characteristic, multiple classification of types of certificate regarding environmentally friendly characteristic is desired, identification and tracking based on the weave repeat of identification region functioning as two-dimensional code would be advantageous.

The weave repeat functioning as two-dimensional code may take various forms such as a plain weave structure or a derived structure from plain weave or a twill weave structure or a derived structure from twill weave or a satin structure or a derived structure from satin weave, and may not be restricted to the current number of sub-attributes but can be adapted to addition of sub-attributes in future. Also, the identification region S15 has an appearance similar to those of other regions in the fastener tape 10, and does not create a shift in appearance of the fastener tape 10 like the impressing or printing of identification sign. Advantageously, the weave repeat may be a non-warp-rib structure or non-weft-rib structure so that variation of two-dimensional code would be ensured in a limited area.

Division based on certification authority, division based on material of thread, and division based on suppliers of thread have been suggested as examples of sub-attributes in accordance with subdivision of environmentally friendly characteristic, but should not be limited thereto. Information such as model number, manufacturing time, and place of manufacturing factory may be divided. In terms of main attribute of biodegradable threads, an embodiment is envisioned where a first sub-attribute guarantees degradation within 5 years, a second sub-attribute guarantees degradation within 5-10 years, a third sub-attribute guarantees degradation in a time period exceeding 10 years.

Note that the identification region S15 may be configured by a structure that looks different relative to one or both regions adjacent thereto. For example, when a weave repeat of an adjacent region includes a plain weave or a derived structure from plain weave, a weave repeat of the identification region may include a twill weave or a derived structure from twill weave or a satin weave or a derived structure from satin weave. When a weave repeat of an adjacent region includes a satin weave or a derived structure from satin weave, a weave repeat of the identification region may include a plain weave or a derived satin structure from plain weave or a twill weave or a derived structure from twill weave.

Figure 11:
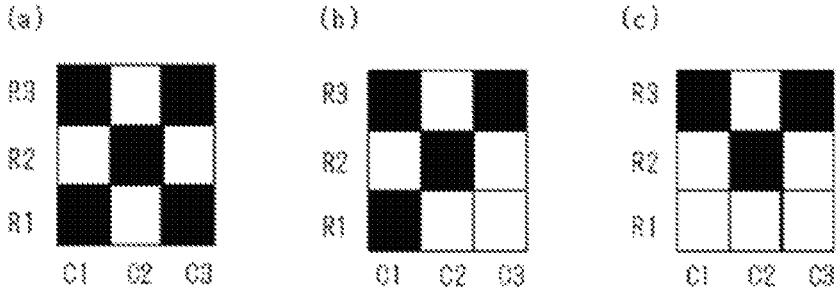
FIG. 11 illustrates variants of weave repeat of identification region.
Figure 12:
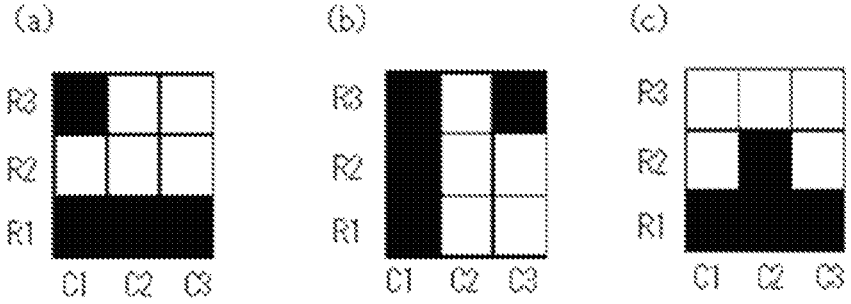
FIG. 12 illustrates variants of weave repeat of identification region.
Figure 13:
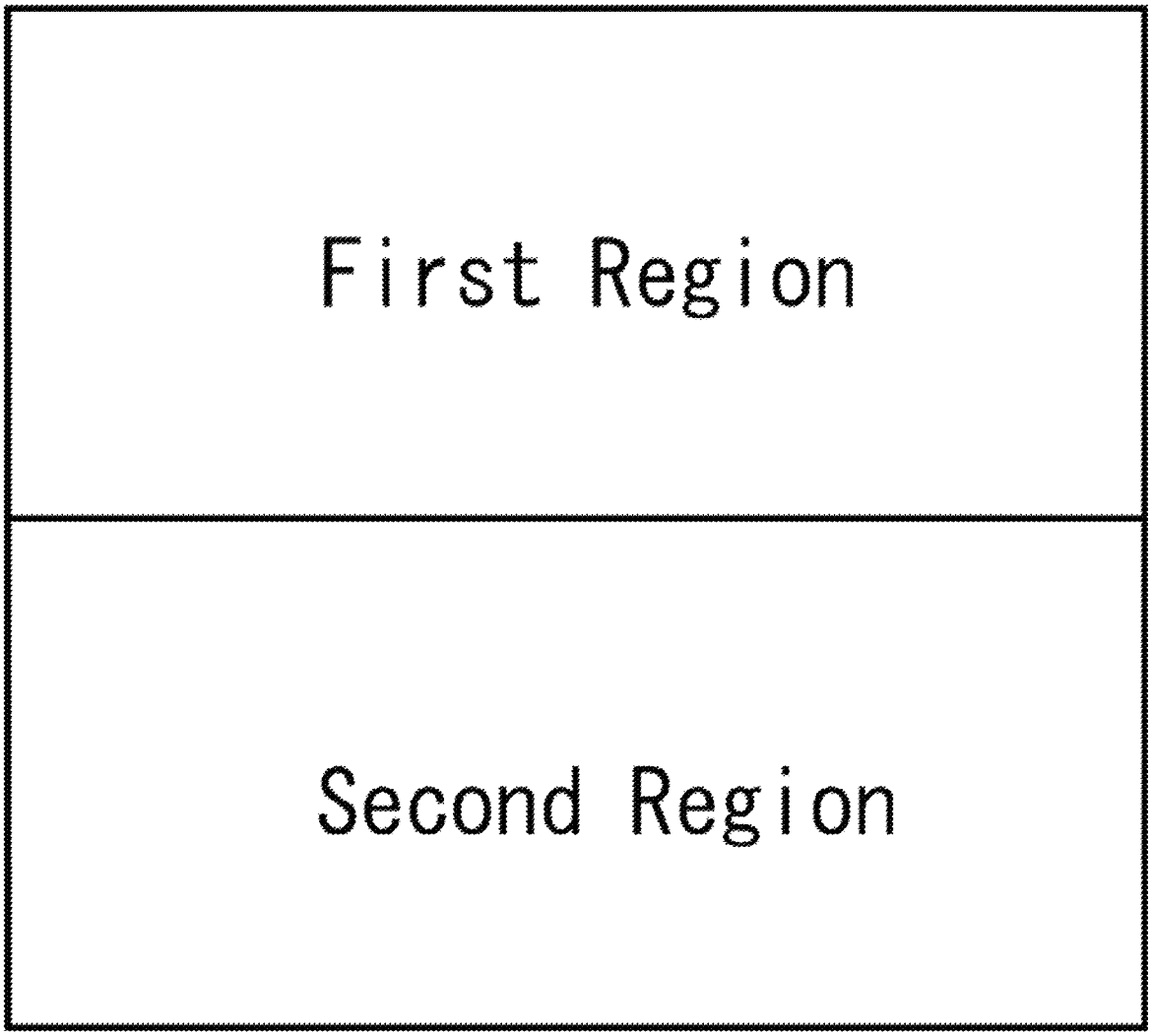
FIG. 13 illustrates variants of weave repeat of identification region.

FIGS. 11-13 show variants of weave repeat of identification region. In FIG. 11, FIG. 11(*a*) illustrates that a weave repeat of 3 rows and 3 columns is a plain weave structure, FIG. 11(*b*) illustrates that a weave repeat of 3 rows and 3 columns is a derived structure from plain weave, and FIG. 11(*c*) illustrates that a weave repeat of 3 rows and 3 columns is a derived structure from plain weave. In a case where a main attribute is subdivided into two sub-attributes, two weave repeats selected from FIGS. 11(*a*)-11(*c*) are used, and it is not necessary to use the pure plain weave structure of FIG. 11(*a*).

In FIG. 12, FIG. 12(*a*) illustrates that a weave repeat of 3 rows and 3 columns is configured by a combination of a rib (at row R1) extending in the weft direction and a dot (at R1,C1), FIG. 12(*b*) illustrates that a weave repeat of 3 rows and 3 columns is configured by a combination of a rib (at column C1) extending in the warp direction and a dot (at R3,C3), and FIG. 12(*c*) illustrates that a weave repeat of 3 rows and 3 columns is configured by a combination of a rib (at row R1) extending in the weft direction and a dot (at R2,C2). Plural pattern species can be similarly obtained based on combinations of rib and dot.

FIG. 13 illustrates an embodiment where a weave repeat is divided into two regions having a first region to which a first weave type (e.g. plain weave or derived structure therefrom) is allocated and a second region to which a second weave type (e.g. a twill weave or derived structure therefrom) is allocated. Manner of division of weave repeat would be various, and should not be limited to the manner of division into two upper and lower regions as shown. It would be possible to divide into three or more regions and allocate different structures to respective regions. By way of such methods, the types of identification region S15 would be increased, and the number of distinguishable sub-attributes would be increased.

As would be understood from the above descriptions, derivation can be possible by various ways such as addition or deletion of filled cells, mirror-image inversion, combinations of different types of structure, and a skilled person would a number of variations based on such disclosure.

Figure 14:
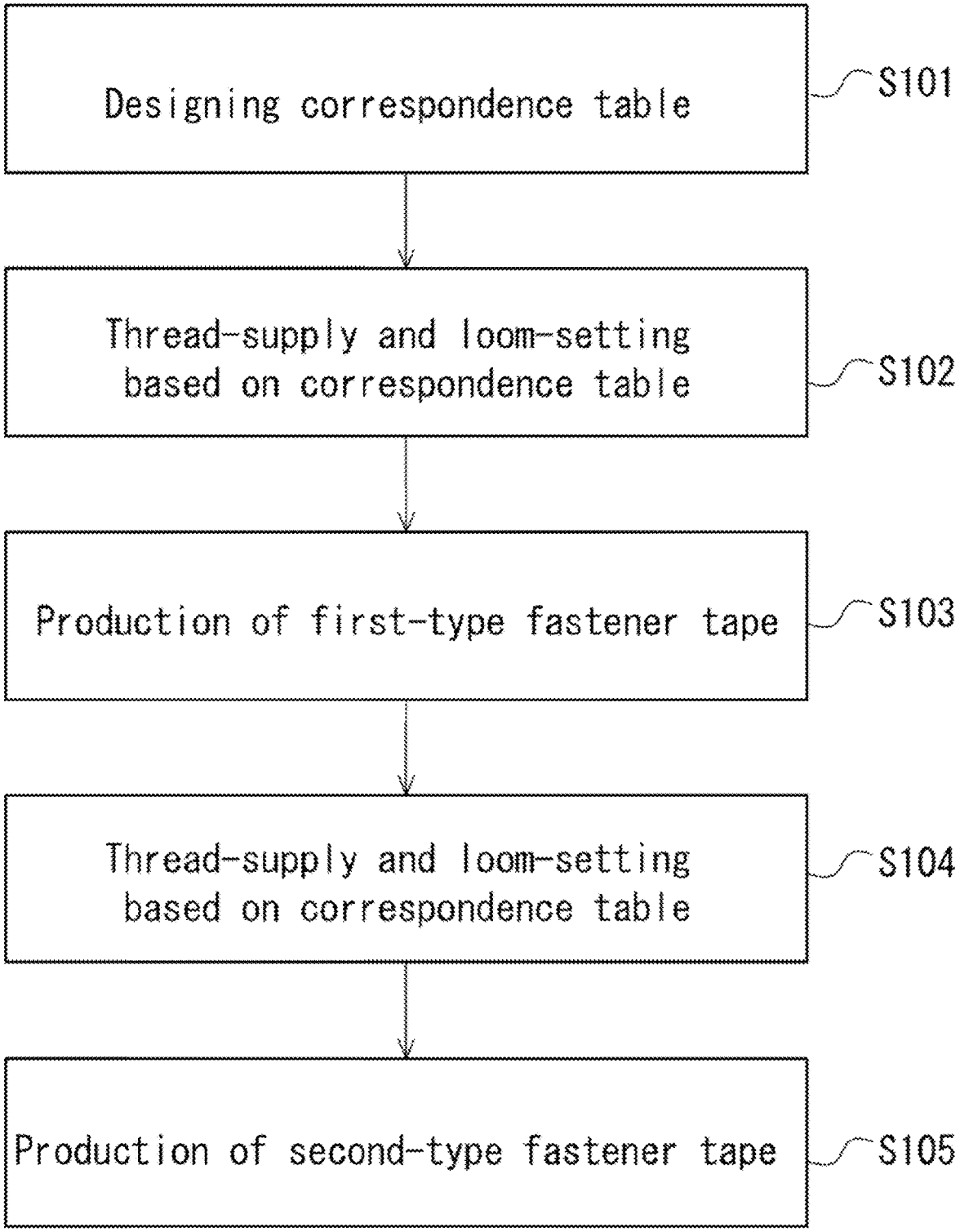
FIG. 14 is a schematic flowchart showing a method of producing fastener tapes.

Finally, a method of producing a fastener tape 10 would be described with reference to FIG. 14. Firstly, a correspondence table (see chart 1 of example of correspondence table) is designed (S101) which shows correspondence between a sub-attribute subdivided from a main attribute and a weave repeat of identification region S15 of fastener tape 10. The correspondence table is quite simple as shown in hereinafter. It is envisaged that the correspondence table is stored in a computer as a look-up table. Human or image-recognition device may identify a sub-attribute of thread, e.g. a certificate, from a weave repeat based on reference to this look-up table.

CHART 1

| Thread | Certificate | Weave repeat of identification region |
|---|---|---|
| A | D | FIG. 5 |
| B | E | FIG. 8 (a) |
| C | F | FIG. 10 |

Next, based on the correspondence table, an automatic loom is set to be in a given cam pattern, and threads (e.g. threads "A") are supplied to the automatic loom (S102). The automatic loom runs so that a first fastener tape is woven (S103). First identification region (e.g. identification region (s) S15 and/or S16 shown in FIG. 4) in accordance with that given cam pattern is formed in the first fastener tape.

Next, based on the correspondence table, the automatic loom is set to be in another cam pattern, and threads (e.g. threads "B") are supplied to the automatic loom (S104). The automatic loom runs so that a second fastener tape is woven (S105). Second identification region (e.g. identification region(s) S15 and/or S16 shown in FIG. 7) in accordance with the another cam pattern is formed in the second fastener tape. The sequence of weaving of the first and second fastener tapes can be freely modified. In cases where the same automatic loom is used, the setting of the automatic loom is changed in an intermediate period between a period of weaving the first fastener tape and a period of weaving the second fastener tape. Advantageously, one can identify that the threads of fastener tapes has a main attribute (e.g. environmentally friendly characteristic) based on the identification region S16 of fastener tape. Additionally or alternatively, one can identify, based on the correspondence table, a sub-attribute of first threads (e.g. certificate "D") from a weave repeat (e.g. FIG. 5) of first identification region. Likewise, one can identify, based on the correspondence table, a sub-attribute of second threads (e.g. certificate "E") from a weave repeat (e.g. FIG. 8 (*a*)) of second identification region. These feature should be apparent from the above-descriptions, and overlapping description will be omitted. One can identify a sub-attribute of third threads (e.g. certificate "F") from a weave repeat (e.g. FIG. 10) of third identification region.

Method of identifying a fastener tape 10 woven from a weft thread 8 and warp threads 9 is also disclosed substantially in the present specification. The present identifying method includes a step of identifying one or more identification regions S15, S16 in the fastener tape 10, and a step of identifying, based on the identified identification region S15,S16, that the weft thread 8 and the warp threads 9 are with a main attribute. The present method may include, in addition to or as an alternative of said identifying that the weft thread 8 and the warp threads 9 are with a main attribute, identifying a sub-attribute preassociated with a structure of the identified identification region S15 among sub-attributes subdivided from the main attribute.

Based on the above teachings, a skilled person in the art could add various modifications to the respective embodiments. Reference signs in Claims are just for a reference and should not be referenced for a purpose of narrowly construing the scope of claim. Embodiment is envisioned where a weave repeat of identification region is a warp rib structure and the number of warp ribs is associated with a sub-attribute. Embodiment is envisioned where a weave repeat of identification region is a weft rib structure and the number of weft ribs is associated with a sub-attribute.

REFERENCE SIGNS

8 Weft thread
9 Warp thread
10 Fastener tape
11 First side-edge
12 Second side-edge
13 Tape main portion
14 Identification region

The invention claimed is:

1. A method of identifying a fastener tape including threads with an attribute, the method comprising:

observing a weave repeat of an identification region of a first fastener tape, the identification region being woven by plural warp threads and at least one weft thread;

determining that the observed weave repeat matches a first weave repeat in a correspondence table; and identifying that threads of the first fastener tape are with a first attribute based on correspondence between the first weave repeat and the first attribute in the correspondence table, wherein the first attribute indicates a sub-attribute subdivided from a main attribute of environmentally friendly characteristic.

2. The method of identifying a fastener tape according to claim 1, wherein a number of said plural warp threads of the identification region is in a range between 3 and 10.

3. The method of identifying a fastener tape according to claim 2, wherein a number of said plural warp threads of the identification region is equal to or less than 7 or equal to or less than 6.

4. The method of identifying a fastener tape according to claim 1, wherein the first fastener tape has first and second side edges by which a width of the first fastener tape in a weft direction of the first fastener tape is defined, and the first fastener tape includes an element-attachment region located adjacent to the first side-edge or closer to the first side-edge than the second side-edge.

5. The method of identifying a fastener tape according to claim 4, wherein the identification region is located adjacent to the second side-edge or closer to the second side-edge than the first side-edge.

6. The method of identifying a fastener tape according to claim 4, wherein a width of the identification region in a weft direction of the first fastener tape is less than a width of an intermediate region in the weft direction of the first fastener tape, the intermediate region being located between the identification region and the element-attachment region.

7. The method of identifying a fastener tape according to claim 1, wherein the correspondence table is configured such that a second weave repeat is associated with a second attribute of threads of a fastener tape.

8. The method of identifying a fastener tape according to claim 7, wherein the correspondence table is configured such that a third weave repeat is associated with a third attribute of threads of a fastener tape.

9. The method of identifying a fastener tape according to claim 1, wherein the correspondence table is stored in a computer as a look-up table.

10. The method of identifying a fastener tape according to claim 1, wherein the first weave repeat is a derived pattern of a twill weave.

11. The method of identifying a fastener tape according to claim 1, wherein the first weave repeat is a derived pattern of a plain weave.

12. The method of identifying a fastener tape according to claim 1, wherein said observing a weave repeat is performed by using a microscope or an imager.

* * * * *